United States Patent [19]

Lupkes

[11] 4,012,152

[45] Mar. 15, 1977

[54] PAINT-APPLYING DEVICE

[76] Inventor: Wilhelm F. Lupkes, Kaap Hoorn 13, Veendam, Netherlands

[22] Filed: July 24, 1975

[21] Appl. No.: 598,960

[30] Foreign Application Priority Data

Dec. 5, 1974 Netherlands ..... 7415896

[52] U.S. Cl. ..... 401/218

[51] Int. Cl.[2] ..... B43M 11/02

[58] Field of Search ..... 401/218, 219, 15, 208

[56] References Cited

UNITED STATES PATENTS

| | | | |
|---|---|---|---|
| 375,919 | 1/1888 | Boyle | 401/219 X |
| 2,528,657 | 11/1950 | Hobe | 401/218 |
| 2,620,498 | 12/1952 | Jockers et al. | 401/218 |
| 3,128,494 | 4/1964 | Hohmann | 401/218 |
| 3,196,479 | 7/1965 | Romoser | 401/208 |

FOREIGN PATENTS OR APPLICATIONS

| | | | |
|---|---|---|---|
| 746,499 | 3/1956 | United Kingdom | 401/218 |

*Primary Examiner*—Lawrence Charles
*Attorney, Agent, or Firm*—Allison C. Collard

[57] ABSTRACT

A paint applicator having a handle, comprising a housing, and a paint transfer roller rotatably mounted in the housing. A paint container has its interior communicating with the interior of the housing by way of an aperture, and a paint applicator roller is rotatably mounted at the outlet of the housing so as to be in rolling engagement with the paint transfer roller, the paint container being laterally disposed with respect to the handle, and the aperture opening into the housing at a region remote from the region of rolling engagement between the two rollers.

7 Claims, 2 Drawing Figures

PAINT-APPLYING DEVICE

Figure 1:
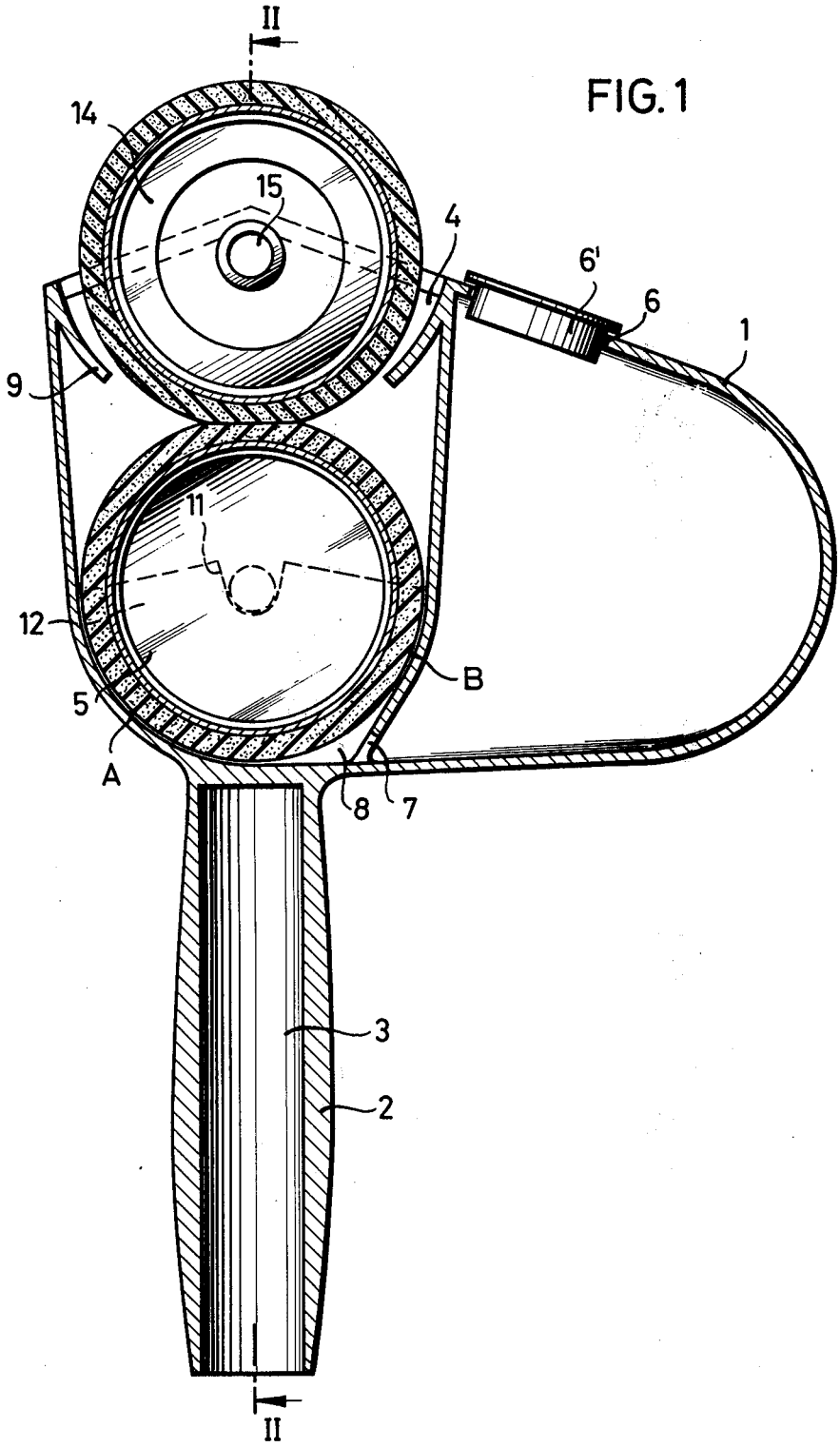

The invention relates to paint applicators of the type having a paint container for supplying paint to a roller by which the paint is applied.

It has become apparent that when working with a paint applicator of this type it is very important that the supply of paint be apportioned simply, and that paint supply can be interrupted when desired so that the paint on the roller can be used up. It is also important that the applicator should be able to be laid aside without the paint running out.

According to the present invention, there is provided a paint applicator having a handle, a housing, a paint transfer roller rotatable in the housing, a paint container having its interior communicating with the interior of the housing by way of an aperture, and a paint applicator roller rotatably mounted at the outlet of the housing so as to be in rolling engagement with the paint transfer roller, the paint container being laterally disposed with respect to the handle, and said aperture opening into the housing at a region remote from the region of rolling engagement between the two rollers.

This lateral positioning of the paint container enables ceilings, walls and also floors to be painted.

It is possible for the paint to be supplied during use when the applicator is in a certain orientation and, when this orientation is altered, for paint supply to be interrupted so that the paint which is on the rollers can be used up. Alteration of orientation is preferably achieved simply by turning the applicator about the axis of its handle.

In order to prevent paint from flowing out when the applicator is laid aside in the wrong position or when it must be used in a position wherein the supply aperture lies such that paint is continually able to flow to the paint transfer roller, it preferably almost touches the housing on both sides of the aperture.

A further improvement in the sealing between the transfer roller and the housing may be achieved by providing the housing in the region of the aperture with portions, at each end of the transfer roller, which closely follow the cylindrical profile of the transfer roller. Paint can be prevented from flowing out of the housing, when the device has been laid aside in the wrong position, by flanges which extend from the edges of the housing outlet into the housing towards the transfer roller.

Good distribution of paint can be achieved by constructing the paint supply aperture as a continuous or interrupted elongate slot extending in the axial direction of the rollers.

Further advantages achieved by a preferred embodiment of the invention are easy insertion and removal of the rollers. To this end, at least one of the rollers is journalled on projections extending inwardly from end walls of the housing, said end walls being sufficiently flexible to permit removal of the roller or rollers from the projections.

The applicator is preferably so shaped that, when the applicator is laid down on a horizontal surface with the handle and paint container contacting said surface, said aperture is at the top of the paint container.

Preferably, the handle has a longitudinally extending opening into which a pole may be inserted.

Figure 2:
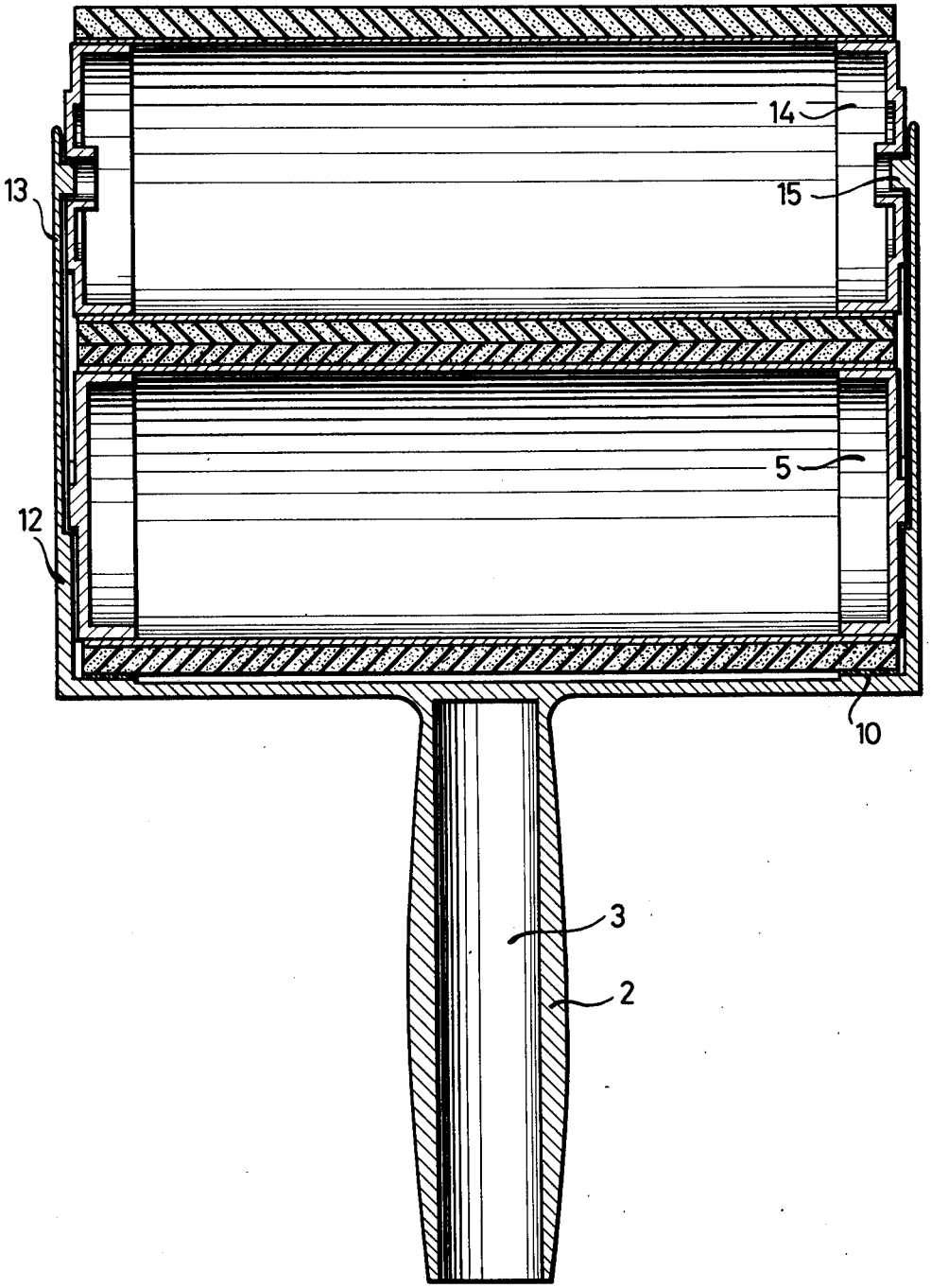

The invention is further described, by way of example, with reference to the accompanying drawings, in which:

FIG. 1 is a section through a paint applicator constructed in accordance with the invention, and FIG. 2 is a section on the line II—II in FIG. 1.

The paint applicator shown in the drawings has a paint container 1, a handle 2 and a housing having end walls 13 between which are journalled a paint transfer roller 5 and a paint applicator roller 14. The container 1 has a filler cap 6 and has its interior communicating with the interior of the housing by way of an aperture 7 in the form of a continuous or interrupted elongate slot extending in the axial direction of the rollers 5 and 14. The paint transfer roller 5 almost touches the housing at regions designated A and B on opposite sides of the aperture 7 so as to define a chamber 8 into which the aperture 7 opens. Referring to FIG. 2, the housing has portions 10 which closely follow the cylindrical profile of the transfer roller 5 at the two ends of the chamber 8 so as to prevent flow of paint around the ends of the transfer roller 5.

The paint transfer roller 5 is rotatably mounted in V-shaped recesses 11 in thickened portions 12 of the end walls 13 of the housing and is retained in the recesses 11 by engagement with the applicator roller 14 which is journalled on projections 15 extending inwardly from the end walls 13. The end walls 13 are resilient and may be flexed outwardly to an extent sufficient to permit disengagement of the roller 14 from the projections 15 whereupon the transfer roller 5 may be exposed and may be lifted from the recesses 11. In an alternative construction (not shown) the transfer roller 5 is journalled on projections in the same manner as the roller 14. Both rollers 5 and 14 have a rigid hollow core carrying a soft porous cover into which the paint penetrates.

The longitudinal edges of the housing outlet in which the applicator roller 14 is mounted have flanges 9 which extend into the housing towards the transfer roller 5 so as to define, with the cylindrical periphery of the applicator roller 14, outwardly diverging slots 4. The flanges 9 serve to prevent free flow of paint out of the housing when the applicator is laid down or used in an inverted position.

The handle 2 is formed with a longitudinally extending opening 3 into which a pole may be inserted so as to increase the effective length of the handle.

In a modified embodiment, the filler cap 6 is positioned in an end wall of the paint container 1 rather than in the top. This modification may simplify the mould in which the body of the applicator is formed.

While only a single embodiment of the present invention has been shown and described, it will be obvious to those skilled in the art that many changes and modifications may be made thereunto without departing from the spirit and scope of the invention.

What is claimed is:

1. A paint applicator comprising:

a housing having a handle and forming a roller compartment adjacent said handle;

a paint transfer roller having a cylindrical profile and a paint applicator roller rotatably disposed parallel and operatively abutting each other in said roller compartment and being oriented perpendicularly and centrally disposed in tandem to said handle, said paint transfer roller being adjacent said handle, the roller compartment including side walls and end walls, said side walls having flanges extending from the edges of said end walls inwardly to the interior of said housing defining a housing outlet through which said paint applicator roller projects;

said housing outlet defining edges of the housing adjacent to a cylindrical surface of said paint applicator roller, said flanges extending from said housing outlet into said housing in a direction towards said transfer roller and away from said side walls;

a partition wall joined to one of said side walls and laterally adjacent said rollers dividing said housing into said roller compartment and a separate paint container, said partition wall being substantially parallel to said handle and curving at a portion adjacent thereto arcuately toward said handle and defining thereat an aperture means opening into said roller compartment adjacent said handle;

each of said flanges together with said paint applicator roller defining a slot which diverges outwardly from an interior of said housing to the exterior thereof, and one of said flanges together with one of said side walls and the other of said flanges with said partition wall forms therebetween means to prevent the free flow of paint out of said housing outlet;

said housing having wall portions at the interior of said end walls which closely follow the cylindrical profile of said transfer roller to prevent the flow of paint around the ends of said transfer roller; and recess means formed in said end walls of said housing in said roller compartment in a portion adjacent said handle, said transfer roller including axle portions rotatably disposed in said recess means, the latter opening in a direction toward said housing outlet and substantially having a U-shape for removably receiving said axle portions.

2. The paint applicator as claimed in claim 1 wherein said aperture means is in the form of a continuous slot which extends parallel to the axis of rotation of said rollers.

3. The paint applicator as claimed in claim 1 in which said aperture means is in the form of an interrupted elongated slot which extends parallel to the axis of rotation of said rollers.

4. The paint applicator as claimed in claim 1 wherein said housing includes end walls having thickened portions and said paint transfer roller is journalled in said recess means formed in said thickened portions of the end walls of said housing.

5. The paint applicator as claimed in claim 4 wherein said end walls include projections and at least one of said rollers is journalled on said projections, the latter extending inwardly from said end walls of the housing, said end walls being sufficiently flexible to permit removal of at least one roller from said projections.

6. The paint applicator as claimed in claim 1, wherein said aperture means is formed at a top of said roller compartment when the applicator is laid down on a horizontal surface with the handle and paint said roller compartment contacting the horizontal surface.

7. The paint applicator as claimed in claim 1 wherein said handle is formed with a longitudinally extending opening adapted to receive a pole.

* * * * *